United States Patent [19]

Larkin et al.

[11] Patent Number: 4,703,864

[45] Date of Patent: Nov. 3, 1987

[54] CONTAINER COVER

[75] Inventors: Mark E. Larkin, Lindenhurst; Edward S. Tripp, Park City, both of Ill.

[73] Assignee: Abbott Laboratories, North Chicago, Ill.

[21] Appl. No.: 858,385

[22] Filed: May 1, 1986

[51] Int. Cl.[4] ..... B65D 41/48

[52] U.S. Cl. ..... 215/256; 220/270

[58] Field of Search ..... 215/256, 255; 220/270

[56] References Cited

U.S. PATENT DOCUMENTS

| | | | |
|---|---|---|---|
| 3,394,831 | 7/1968 | Bathish et al. | 215/249 |
| 3,465,910 | 9/1969 | Richie . | |
| 4,199,071 | 4/1980 | D'Amico | 215/256 |
| 4,385,708 | 5/1983 | Curry | 215/256 |
| 4,534,481 | 8/1985 | Summers et al. | 215/255 X |
| 4,614,515 | 9/1986 | Tripp et al. | 604/403 |

*Primary Examiner*—Donald F. Norton

*Attorney, Agent, or Firm*—Neuman, Williams, Anderson & Olson

[57] ABSTRACT

A unitary molded plastic cover for a container such as a medicament vial is disclosed in which a removable cap portion is attached by a severable tear strip. A pull ring is disposed around the cap portion and attached to the tear strip through torsion hinge sections which permit pivoting of the ring from its surrounding position to a raised access position for gripping and pulling to remove the tear strip and the cap.

21 Claims, 14 Drawing Figures

CONTAINER COVER

This invention relates to container covers with removable portions and particularly to molded plastic covers for application over the access ends of containers such as vials to protect the access ends while providing convenient removal of the end covers by a user.

The invention is useful in systems for delivering pharmaceuticals and other products under sterile conditions, for example as disclosed in the patent application Ser. No. 565,126 of Larkin, filed Dec. 23, 1983, now U.S. Pat. No. 4,614,267, and in our patent application Ser. No. 800,369, filed Nov. 21, 1985, now U.S. Pat. No. 4,614,515 (both of which are incorporated herein by reference), and as currently practiced in the ADD-Vantage system of Abbott Laboratories. In such systems, protective covers are provided over at least the access or "finish" end of a container such as a medicament vial. The containers typically are assembled, filled and sterilized in automated processes which include application of the protective cover. The covers may be applied prior to sterilization or in a sterile environment after the components and contents are sterilized. The covers protect the access openings and surrounding structures from contamination during subsequent handling, shipping and storage up to the time of use of the contents of the container.

The cover over the access end of each container typically is removed by the user, e.g., a health care person such as a nurse or a pharmacist, just prior to using the contents. It is highly desirable that the cover provide for easy gripping and convenient removal from the container assembly by such users. To this end, a ring shaped pull tab is desirable. However, it is also highly desirable that the cover be of a unitary design for economical manufacture by molding of plastic and that the end of the container cover be clear and open for convenient engagement with assembly equipment and installing tools to facilitate automated handling, conveying and assembly with a container such as a medicament vial. Further, it is desirable that the pull ring be positioned to avoid entanglement with other units or with assembly equipment. At the same time, the ring and cover arrangement should accommodate a predetermined, controlled and reliable opening action by a convenient and natural pulling action by the user.

It is the object of this invention to provide improved container covers, and particularly to provide covers and covered containers which meet the above noted desirable requirements and have the desired characteristics.

To those ends, an improved container cover is provided which is a unitary molded plastic article. The cover comprises a cap potion for covering one end of a container, a further portion for engaging the body of the container, a removable tear strip between and joining the cap portion and the body portion, and a pull ring disposed around the cover, and spaced from the respective end. The pull ring is joined to the tear strip in a manner whereby the ring conveniently may be pivoted from its encircling position to an outward exposed position and then be engaged and pulled outwardly by the user for positive, controlled and reliable removal of the tear strip and the cap portion.

For a more complete understanding of the invention, reference will now be made to the accompanying drawings wherein.

DETAILED DESCRIPTION OF THE ILLUSTRATED EMBODIMENTS

Figure 5:
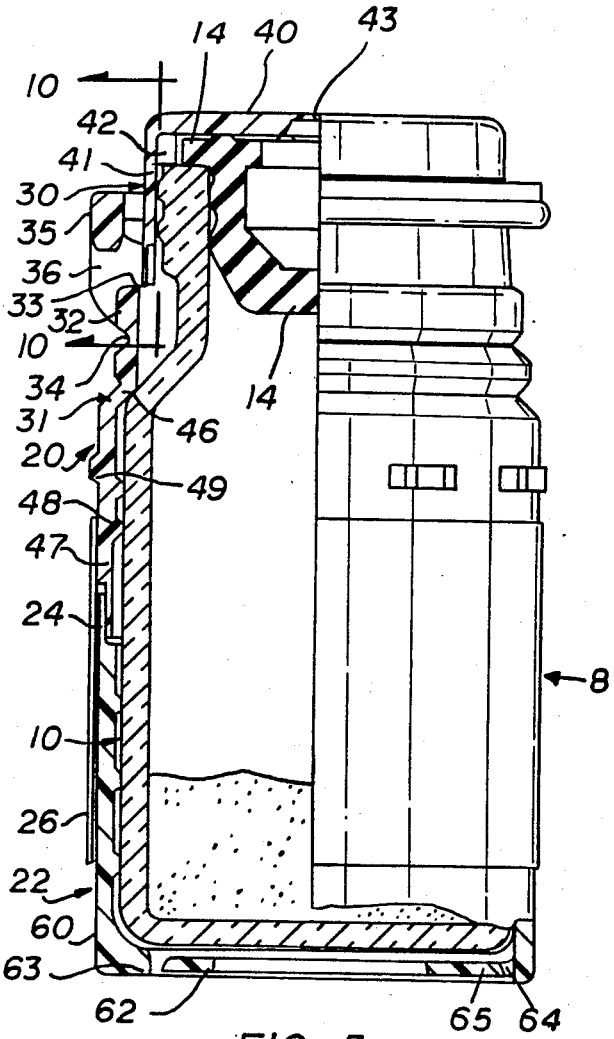
FIG. 5 is a sectional view of one-half of the vial and cover of FIG. 1, as taken along a radius, with the other half in elevation (generally along planes 5—5 of FIG. 1).
Figure 6:
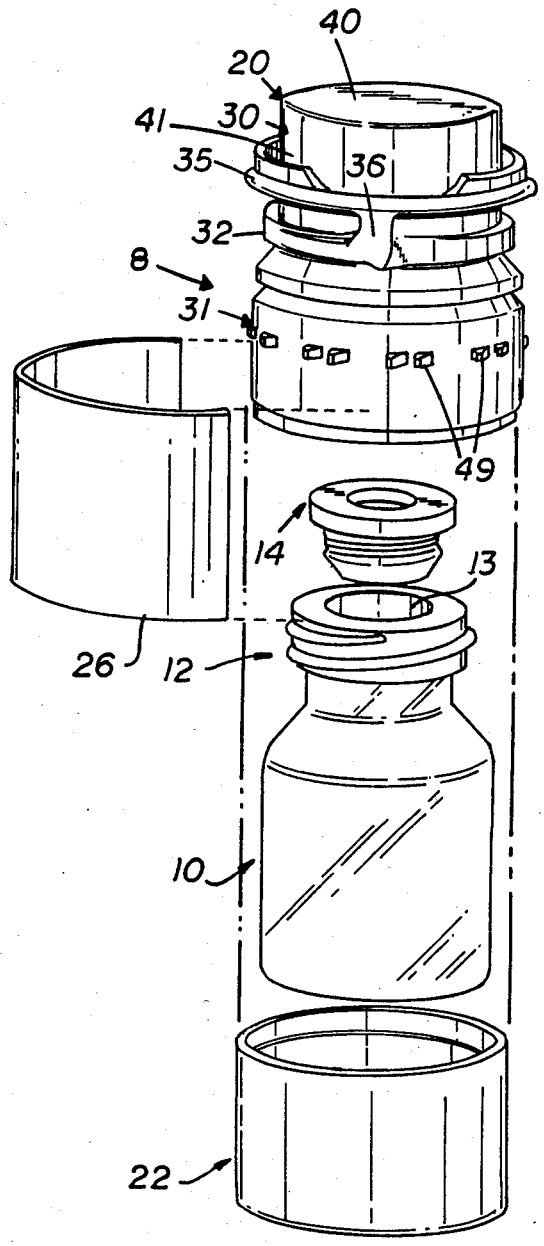
FIG. 6 is an exploded perspective view of the vial assembly of FIG. 1.
Figure 7:
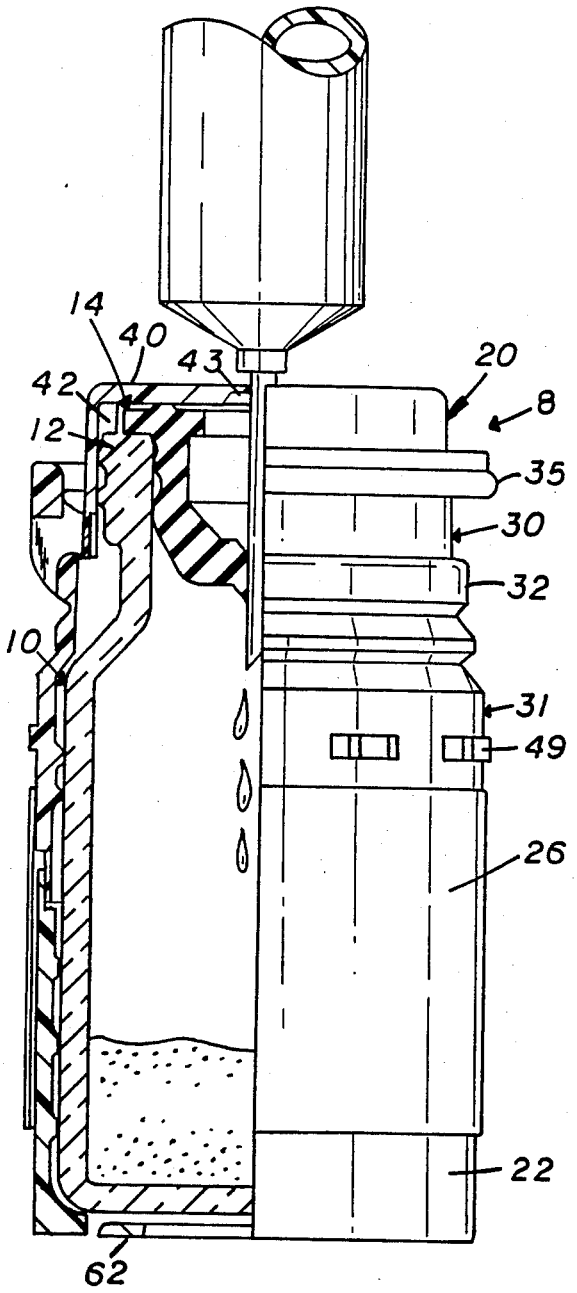
FIG. 7 is a view similar to FIG. 5 illustrating another manner of use of the covered vial of FIG. 1.

Referring particularly to FIGS. 5–7 of the drawings, a vial assembly 8 includes a vial 10 having a threaded finish end 12 with an access opening 13 closed by a hollow removable stopper 14. The threaded vial and hollow stopper are designed for use in the manner described in the aforementioned applications and in the ADD-Vantage system.

With further reference to the other Figures of the drawing, the vial 10 is enclosed by a cover 20 and a shroud 22 which join one another at an overlap joint 24. The cover and shroud are further secured together by an adhesive label 26 which spans the joint 24. The cover is a unitary plastic molding of a suitable plastic such as a polypropylene or polyethylene which is accurately moldable to close tolerances, dimensionally stable, relatively rigid (inelastic) and frangible or tearable. The shroud portion 22 may be of similar materials but typically one which is more flexible and resilient.

The cover 20 includes a first or cap portion 30, a second or body engagement portion 31, a tear strip 32 intermediate the portions 30 and 31 and joined thereto by tear detail joints 33 and 34, and a pull ring 35. A section of the pull ring at one side is joined to the tear strip through a force transfer element 36.

The cap portion 30 includes an end wall 40 and an annular skirt section 41 which surrounds and extends slightly below the threaded neck of the vial. Several seating ribs 42 are provided on the inner surface of the cap. These ribs are of a radial and axial extent to provide an abutment stop for the finish end of the vial, as best seen in FIGS. 5 and 7, to avoid pressure contact between the outer end surface of the stopper 14 and the inner surface of cap wall 40. This precludes any sticking of these elements to one another.

The end wall 40 has a thin diaphragm section 43 to facilitate insertion of a cannula or syringe needle therethrough in one mode of use of the covered vial, as illustrated in FIG. 7. This diaphragm preferably is provided by coring the wall 40 from the bottom, as illustrated. This maintains a smooth planar outer surface for ease of cleaning and avoids puddling of disinfectant such as can occur when the wall is cored from the outside.

The body engagement portion 31 is formed with a shoulder 46 which may serve as a stop seat for the shoulder of the vial. The depending cylindrical portion 47 fits closely about the cylindrical main body of the vial 14 and includes a pair of annular sealing ridges 48 for tight sliding contact with the vial to provide effective barriers to entry of bacteria or other organisms. Thereby the cover 20 maintains sterility on and around the neck and finish end portion of the vial. The sealing ridges may be continuous annuli or may have short interruptions to permit escape of entrapped gas during assembly of the cover 20 on the vial. An annular array of ratchet teeth 49 is provided on the outer surface of portion 47 for interlocking engagement with complementary teeth of an inlet port on a diluent bag or other dispensing container in one mode of use of the covered vial, as further described in the aforementioned application Ser. No. 800,369. (U.S. Pat. No. 4,614,515).

Figure 1:
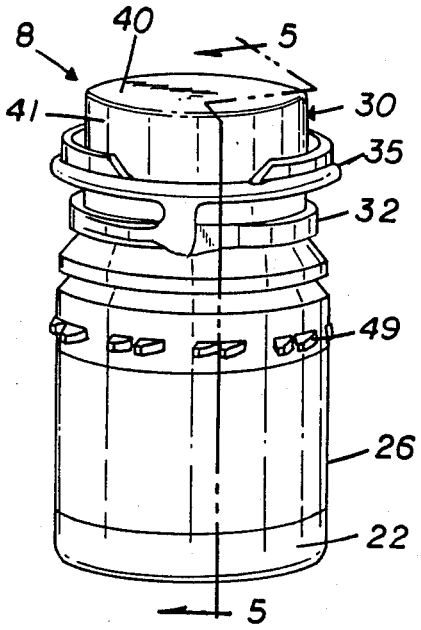
FIG. 1 is a perspective view of a vial assembly employing teachings of this invention.
Figure 2:
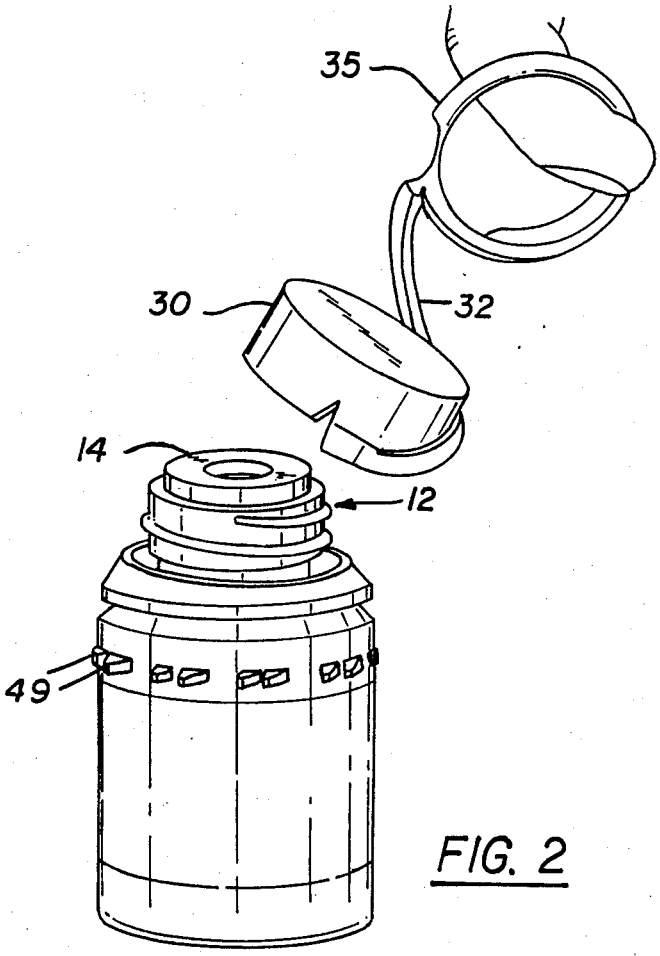
FIG. 2 is a perspective view of the vial assembly of FIG. 1 after the top portion of the cover and the related tear strip and pull ring have been removed, such as for joining with an IV container as described in said applications Ser. No. 565,126 and 800,369 and respective patents and as practiced in the noted ADD-Vantage system.
Figure 3:
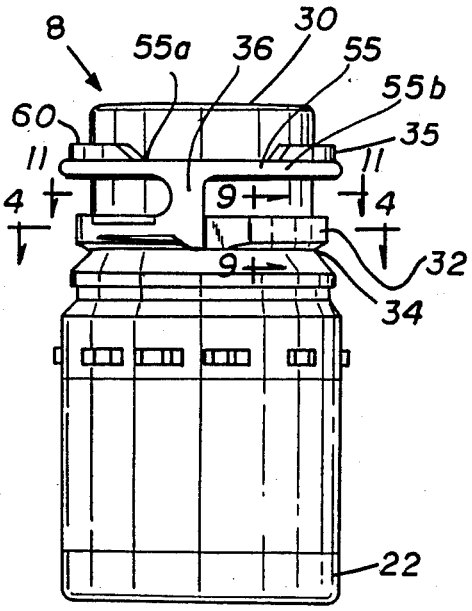
FIG. 3 is a front elevation view of the vial assembly of FIG. 1.
Figure 4:
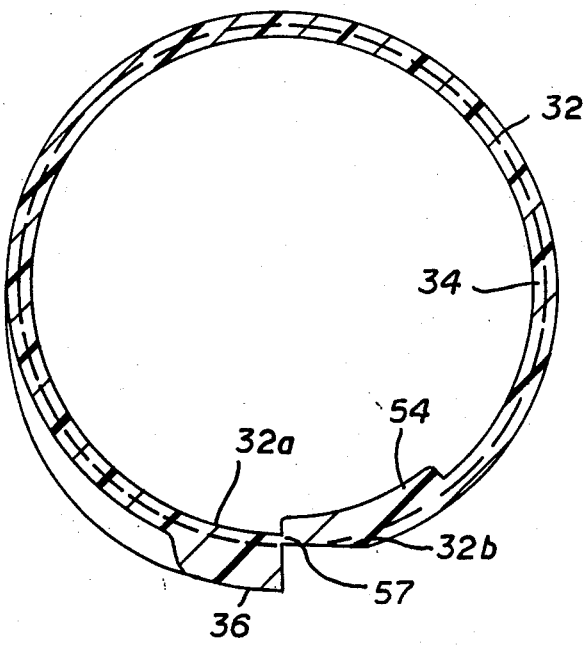
FIG. 4 is a cross-section of the cover of FIG. 1, taken generally along line 4—4 of FIG. 3.
Figure 12:
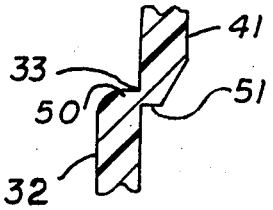
FIG. 12 is an enlarged view of the upper tear detail.

The tear detail 34 is defined by a thin frangible wall joint section at the apex of a V-shaped groove in the outer portion of cover 20, as illustrated. This tear joint completely encircles the cover. With particular reference to FIG. 12 as well as to FIGS. 5 and 7, the frangible tear detail 33 is formed by a thin wall section between two offset sharp corners defined between an external shoulder 50 at the upper edge of the tear strip 32 and an internal shoulder 51 at the lower edge of the skirt section 41 of the cap portion 30. (As used herein, "upper" and "lower" have reference to the orientation of a vial unit with the cap and access opening upward as seen in FIGS. 1, 3, 5, 6 and 7). The tear detail 33 is interrupted by a shoulder or thickened wall portion 54 which forms a tear stop at the remote or tail end **32*b* of the tear strip 32, see FIG. 4. This insures that the cap portion and tear strip will remain attached to one another upon removal from the vial assembly 8, see FIG. 2**.

The pull ring 35 is disposed around the cover 20, circumscribing the cap portion 30. With the ring spaced beneath the upper surface of the end wall 40, this end surface and the adjacent upper portion of the skirt wall 41 remain clear and unobstructed, as seen in FIGS. 1, 3 and 5–7. This arrangement permits convenient handling of the covers and convenient engagement by assembly equipment and installing tools during assembly of the cover with the vial. The end wall 40 defines a reference surface in a predetermined relationship to the remainder of the cover. Thus, it provides a flat stable surface, disposed generally normal to the longitudinal center axis of the cover and of the assembly, on which each cover or the respective assembly may rest while being conveyed and which may be engaged by pressing devices when telescoping the cover and vial together. Having the ring spaced beneath the end wall surface further exposes a portion of the cylindrical skirt wall 41 for gripping of the cover and particularly accommodates engagement by conical engagement fixtures or other fixtures or tools which engage the cover over the upper end.

Figure 10:
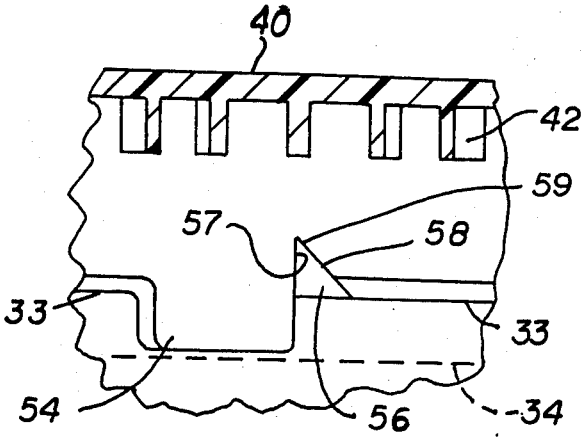
FIG. 10 is a partial sectional view of the cover taken along the line 10—10 of FIG. 5.
Figure 11:
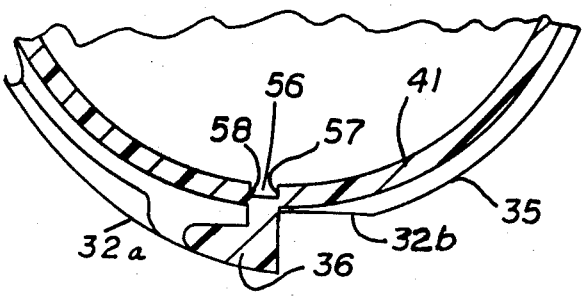
FIG. 11 is a partial sectional view of the cover taken along line 11—11 of FIG. 3.

One section 55 of the pull ring 35 is unitary with the upper end of the force transfer element 36. A lower portion of the element 36 is unitary with the segment **32*a* of the tear strip 32 which is the leading end segment during removal; see FIG. 4. Referring also to FIGS. 10 and 11, a rear or inward portion of the force transfer element 36 is unitary with the other cover elements along frangible tear details 57 and 58. One thin-walled vertical tear line detail joint 57 extends from tear detail joint 34 upward along one side of the element 36. This joint traverses the tear strip 32, between leading end portion 32*a* and the distal or tail end portion 32*b*, and extends upward into the skirt wall 41, as best seen in FIG. 10. Another thin-walled tear line detail joint 58 extends angularly upward from tear detail joint 33 into the wall 41, in converging relation with the joint 57. Thus, the joints 57 and 58 define a sharp force concentrating apex 59 behind or subjacent an upper portion of the element 36. This provides a small area or point for relatively easy initiation of tearing of the joints 57 and 58 to begin removal of the tear strip and the cap portion. That tearing of course progresses from the tear details 57 and 58 to the tear details 34 and 33, respectively, when the tear strip and cap are being removed. A triangular recess 56 may be formed on the inside surface of the skirt, between lines 57 and 58**, to facilitate the formation of these tear details as illustrated.

As indicated by its thickness and short length, element 36 is quite rigid, i.e. unbending. The leading end segment **32*a* of the tear strip is relatively thick where it joins the element 36 and tail segment 32*b* is relatively thin at its junction with element 36 at joint 57 (see FIG. 4). This insures integrity between the leading end segment and element 36, and insures that severance will occur only between the tail segment 32*b* and element 36 when element 36 is pulled outward to initiate removal of the tear strip. Each of these end segments tapers to the normal thickness of strip 32, see e.g. FIG. 4**.

The pull ring 35 includes an upstanding flange 60 extending along most of its distal length, as illustrated. This provides added width to the ring to avoid any discomfort to the user when applying pulling forces by a finger as in FIG. 8 for removal of the cap. The flange 60 also adds rigidity to the ring for maintaining it in the desired configuration and disposition.

Figure 8:
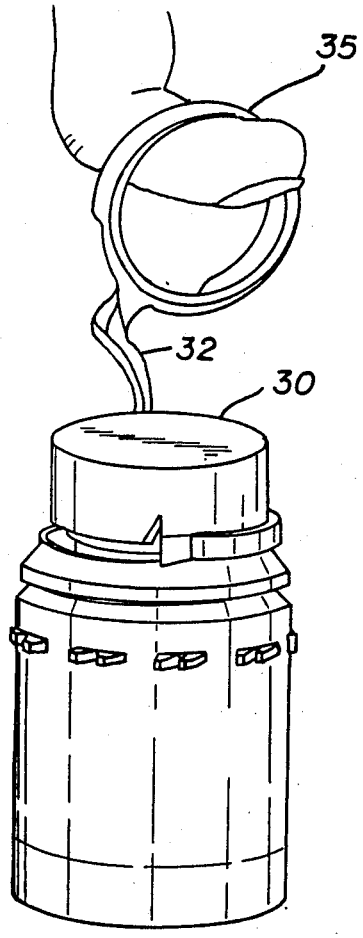
FIG. 8 is a perspective view illustrating a step in the removal of the tear strip and top portion of the cover.
Figure 9:
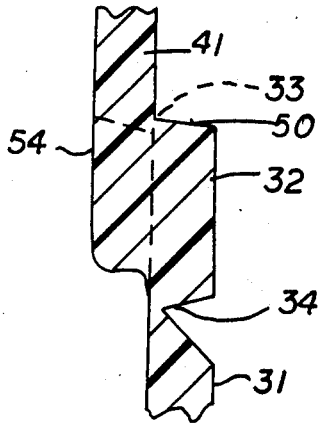
FIG. 9 is a partial sectional view of the cover taken along the line 9—9 of FIG. 3.

The section 55 of the pull ring which joins to the element 36 is of reduced cross section, relative to the remainder of the ring, to form torsion bar hinges of the ring segments **55*a* and 55*b* on each side of the force transfer element. Thus, the ring may be molded in its normal circumscribing relation to the cover, as shown in FIGS. 1, 3, 5, 7 and 13 of the drawings, and will remain in that position during normal handling of the cover and during assembly of the cover with the vial and other components. However, when a user desires to remove the cap portion, it is easy to pivot the ring upward over the cap to an upstanding open access position by torsional flexure of the segments 55*a* and 55*b*. Then the user can insert a finger, as illustrated in FIG. 8, or a suitable engagement tool, for convenient positive gripping to apply the pulling force necessary to sever the tear strip and the cap portion from the covered vial to expose the finish end, see FIGS. 2 and 8. This pulling force preferably is applied radially outward (into the paper in FIG. 8) to initiate the tearing, and then upward. The attendant forces on the element 36 first are concentrated as an outward pull at the apex 59 and readily initiate tearing at the apex 59. Further tearing removal thereupon progresses by normal finger pulling force applied generally axially of the assembly 8, as shown in FIG. 8. This force application may include orbital movement of the hand about the extended center axis of the assembly. As a result, the tear details both are severed quickly and easily, with the severance along line 33 stopping at tear stop 54 to retain components 30, 32 and 35 together, as the cap portion is conveniently removed at joint 34; see FIG. 2**.

Providing torsion bar hinge segments 55*a* and 55*b* permits the use of a relatively rigid or fixed-shape ring for ease of gripping while assuring that the ring can be pivoted from its molded position around the cap to an upward or even rearwardly extending access position for applying pulling forces without breaking the ring or the force transfer element. Thus, controlled hinge action is provided. The strength of the relatively short torsion bar segments also maintains control over the position of the ring on the vial assembly during handling, assembling and all operations up to the time of the use of the ring for removal purposes. Alternatively, if it is found desirable, as with materials and configurations of greater flexibility, the distal portion of the ring may be further retained in the desired position by one or more thin, breakable stringers or tie straps molded in place between the ring and the skirt 41.

Figure 13:
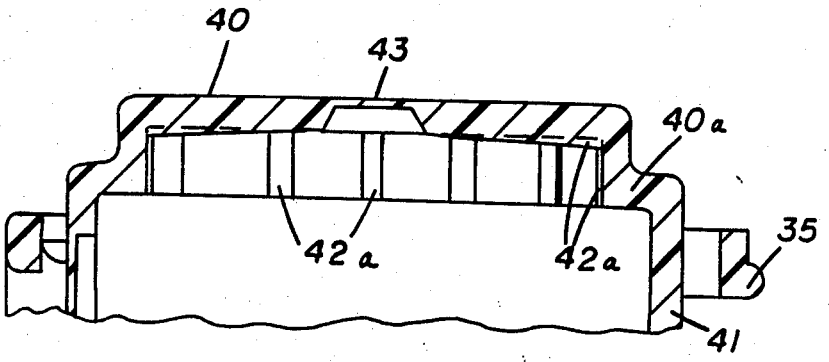
FIG. 13 is a partial sectional view illustrating a modified top portion of a cover which otherwise is like the cover of FIG. 1.

FIG. 13 illustrates an alternative design for the vial stop arrangement in the cap portion. In this design, the cap portion is formed with an annular shoulder 40*a* to abut the finish end of the vial neck, like the ribs 42 of FIG. 5. Here the remaining ribs 42*a* project only slightly from the inner annular wall and from the inside of the end wall within the shoulder to further preclude extensive surface contact of the stopper 14 in these areas.

Figure 14:
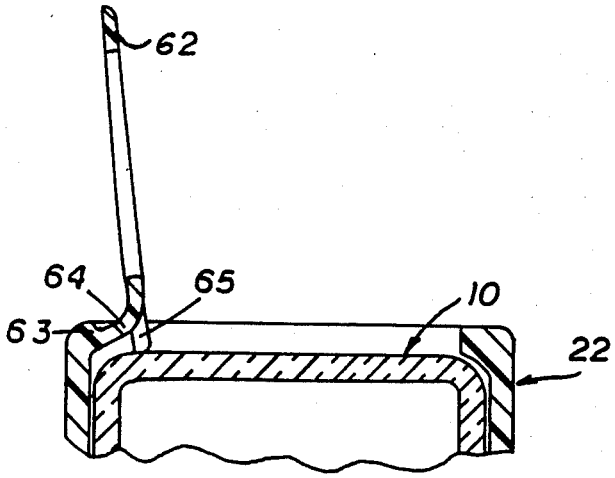
FIG. 14 is a partial sectional view illustrating the hanger ring of the vial assembly of FIG. 1 in the upright position for hanging the assembly and attached components.

The shroud portion 22 includes a cylindrical body portion 60 which is complementary with the cover 20 for enclosing the lower portion of the vial, as illustrated. A bottom hanger ring 62 is included and has a living hinge connection 64 to the bottom rim 63. Means may be included to selectively retain the ring 62 in a raised position for use as a hanger for suspending the vial assembly and a diluent bag or other components that may be attached thereto. For example, a flexible retainer latch may be provided as disclosed in said application Ser. No. 800,36.9 (U.S. Pat. No. 4,614,515). Alternatively, a flexible extension finger 65 may be provided adjacent the living hinge, with the finger being of a length for abutment with the base of a vial 10 but sufficiently flexible to be forcibly moved over-center from the position of FIG. 5 to a bracing position as in FIG. 14 to retain the hanger upright.

While the bottom section of the enclosure is shown as a shroud which compliments the cover 20, it is contemplated that covers employing this invention may be provided which would be secured to the container in other ways, such as by engagement directly and solely with the body of the container or by other retaining means.

It is thus seen that a novel container cover has been provided which meets the aforestated objects.

While certain embodiments have been illustrated and/or described in detail, it will be understood that the invention is not limited to those embodiments. Accordingly it is intended by the claims herein to cover any modifications and other embodiments which incorporate those features which embody the essential aspects of this invention.

What is claimed is:

1. A unitary molded plastic cover for a container, said cover comprising:

a cap portion for covering one end of a container and having an end surface;

a body portion for engaging said containing in spaced relation to said end;

a tear strip circumscribing said cover between said cap portion and said body portion and joined to each of said portions along an annular frangible joint; and a pull ring joined to said tear strip and circumscribing and spaced radially outward of said cover, said pull ring being disposed inward of said cover from said end surface and outward of said tear strip, whereby said tear strip and said frangible joints are exposed radially outward, said end surface is unobstructed and said ring may be lifted and pulled to sever said frangible joints.

2. The invention as in claim 1, wherein said end surface is flat and disposed generally normal to the longitudinal central axis of said cover.

3. The invention as in claim 1, wherein said frangible joint between said tear strip and said cap portion is formed by a thin section of said cover between an external shoulder at the respective edge of said strip and an internal shoulder of said cap portion.

4. The invention as in claim 1 wherein said cap portion has a cylindrical outer surface and said tear strip is of an outside diametral dimension greater than said cap portion and includes an external annular shoulder exposed outwardly toward said end surface, said frangible joint between said tear strip and said cap portion being define by a thin section of said cover between a sharp corner defined by said cylindrical outer surface and said annular shoulder and an opposed internal shoulder.

5. The invention as in claim 4 wherein said opposed internal shoulder is a sharp corner defined by an internal cylindrical surface of said tear strip and an annular shoulder on the inward end of said cap portion.

6. A unitary molded plastic cover for a container, said cover comprising:

a cap portion for covering one end of a container and having an end surface;

a body portion for engaging said containing in spaced relation to said end;

a tear strip between said cap portion and said body portion and joined to each of said portions along a frangible joint; and a pull element joined to said tear strip whereby said element may be grasped and pulled to sever said frangible joints, said cover including a force transfer portion unitary with said tear strip and with one section of said pull element for applying forces from said pull element to said tear strip, wherein said force transfer portion also is joined to other portions of said cover along converging frangible joints defining an apex adjacent said one section of said pull element.

7. The invention of claim 6 wherein said pull element is a pull ring.

8. The invention of claim 6 wherein said pull element is a pull ring circumscribing said cover inward from said end surface whereby said end surface is unobstructed.

9. The invention of claim 6, 7 or 8 wherein said pull ring includes portions at each side of said section which are flexible in torsion whereby said ring may be rotated from its position circumjacent said cover by torsional flexing of said portions for pulling outward on said section and severing said joints.

10. A unitary molded plastic cover for a container, said cover comprising:

a cap portion for covering one end of a container, said cap portion having an end surface and a cylindrical outer surface;

a body portion for engaging said container in spaced relation to said end;

a tear strip circumscribing said cover between said cap portion and said body portion and joined to each of said portions along an annular frangible joint, said tear strip being of an outside diametral dimension greater than said cylindrical outer surface and including an external annular shoulder exposed outward toward said end surface, said cylindrical outer surface and said annular shoulder meeting one another in a sharp corner which delineates said frangible joint between said tear strip and said cap portion;

a pull ring joined to said tear strip and circumscribing and spaced radially outward of said cap portion inward from said end surface, whereby said cylindrical surface and said shoulder both are accessible from the end of said cover corresponding to said end surface, said end surface is unobstructed and said ring may be lifted and pulled to sever said frangible joints.

11. The invention as in claim 10 wherein said frangible cover includes an internal sharp corner at the inner edge of said cap portion further delineating said frangible joint between said tear strip and said cap portion.

12. The invention comprising a vial having a finish end, a closure for said finish end, and a unitary molded plastic cover as in claim 1, 6, 7, 3, 4, 5, 10 or 11 disposed over said finish end and at least the adjacent portion of said vial, said cap portion thereby covering said finish end and being removable therefrom by pivoting and pulling said pull ring to remove said tear strip and said cap portion.

13. A unitary molded plastic cover for a container, said cover comprising:

a first cover portion for covering a first portion of such a container;

a second cover portion for circumscribing a portion of such container;

a tear strip between said first and second portions and joined to each of said portions along a frangible joint; and a rigid pull ring of fixed shaped cicumscribing said cover and including a section joined to said tear strip, portions of said pull ring at each side of said sections being of reduced cross section relative to the remainder of said ring to form flexible torsion bar hinges whereby said ring may be pivoted from its position circumscribing said cover by flexing of said portions, for applying outward force on said section to tear said cover along said joints for removal of said first cover portion.

14. The invention of claim 13 where in said cover includes a force transfer portion unitary with said tear strip and with said section of said pull ring for applying forces from said pull ring to said tear strip.

15. The invention of claim 14 wherein said force transfer portion is a rigid portion.

16. A unitary molded plastic cover for a container, said cover comprising:

a first cover portion for covering a first portion of such a container;

a second cover portion for circumscribing a portion of such container;

a tear strip between said first and second portions and joined to each of said portions along a frangible joint; and a pull ring circumscribing said cover and including a joining section, a rigid force transfer portion unitary with said tear strip and with said section of said pull ring for applying forces from said pull ring to said tear strip, said force transfer portion being joined to other portions of said cover along frangible joints which converge with one another in a direction toward said pull ring from said tear strip, portions of said pull ring at each side of saids section being flexible in torsion whereby said ring may be pivoted from its position circumscribing said cover by torsional flexing of said portions, for applying outward force on said section to tear said cover along said joints said for removal of said first cover portion.

17. The invention as in claim 16 wherein said converging joints form an apex subjacent said force transfer portion.

18. The invention as in claim 16, wherein said converging joints form an apex adjacent said section of said pull ring.

19. The invention comprising a vial having a finish end, a closure for said finish end, and a unitary molded plastic cover as in claim 13, 4, 15, 16, 17, 18, or 21 disposed over said finish end and at least the adjacent portion of said vial, said first portion covering said finish end and being removable therefrom by pivoting and pulling said pull ring to remove said tear strip and said cap portion.

20. The invention as in claim 1, 13, 14, 15, 17, 18, 6, 7, 8, 3, 4, 5, 10, 11, 16 or 21 wherein said cover is of cylindrical configuration.

21. A unitary molded plastic cover for a container, said cover comprising:

a first cover portion for covering a first portion of such a container;

a tear strip between said first and second portions and joined to each of said portions along a frangible joint; and a pull ring circumscribing said cover and including a section joined to said tear strip, portions of said pull ring at each side of said section being flexible in torsion whereby said ring may be pivoted from its position circumscribing said cover by torsional flexing of said portions, for applying outward force on said section to tear said cover along said joints for removal of said first cover portion;

wherein said frangible joint between said tear strip and said second cover portion cirumscribes said cover and said frangible joint between said tear strip and said first portion terminates short of the distal end of said tear strip whereby said first portion remains attached to said tear strip when said tear strip is removed from said second portion.

* * * * *

UNITED STATES PATENT AND TRADEMARK OFFICE

CERTIFICATE OF CORRECTION

PATENT NO. : 4,703,864

DATED : November 3, 1987

INVENTOR(S) : Mark E. Larkin; Edward S. Tripp

It is certified that error appears in the above—identified patent and that said Letters Patent is hereby corrected as shown below:

Column 6, line 40: Change --define-- to "defined"

Column 8, line 23. Change --saids section-- to "said section"

Signed and Sealed this

Twenty-fourth Day of May, 1988

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,703,864

DATED : November 3, 1987

INVENTOR(S) : MARK E. LARKIN and EDWARD S. TRIPP

It is certified that error appears in the above-identified patent and that said Letters Patent is hereby corrected as shown below:

Col. 6, line 12, "containing" should read --container--.

Col. 6, line 32, after "said" insert --tear--.

Col. 6, line 51, "containing" should read --container--.

Col. 7, line 42, after "1,6,7," insert --8--.

Col. 7, line 63, after "by" insert --torsional--.

Col. 7, line 67, correct "where in" to read --wherein--.

Col. 8, line 37, "4" should read --14--.

Signed and Sealed this

Twenty-fourth Day of January, 1989

*Attest:*

DONALD J. QUIGG

*Attesting Officer*

*Commissioner of Patents and Trademarks*